US010138881B2

(12) United States Patent
Centofante

(10) Patent No.: US 10,138,881 B2
(45) Date of Patent: Nov. 27, 2018

(54) FLUID PUMP WITH PULSE REDUCTION

(71) Applicant: Piranha Plastics, LLC, Santa Clara, CA (US)

(72) Inventor: Charles A. Centofante, Santa Clara, CA (US)

(73) Assignee: Piranha Plastics, LLC, Santa Clara, CA (US)

( * ) Notice: Subject to any disclaimer, the term of this patent is extended or adjusted under 35 U.S.C. 154(b) by 0 days.

(21) Appl. No.: 15/391,689

(22) Filed: Dec. 27, 2016

(65) Prior Publication Data

US 2018/0180038 A1 Jun. 28, 2018

(51) Int. Cl.

| | |
|---|---|
| ***F04B 43/12*** | (2006.01) |
| ***F04B 49/06*** | (2006.01) |
| ***F04B 53/16*** | (2006.01) |
| ***F04B 13/00*** | (2006.01) |
| ***F04B 43/02*** | (2006.01) |

(52) U.S. Cl.
CPC ..... *F04B 43/1269* (2013.01); *F04B 13/00* (2013.01); *F04B 43/02* (2013.01); *F04B 49/065* (2013.01); *F04B 53/16* (2013.01)

(58) Field of Classification Search
CPC ..... F04D 43/1253; F04D 43/1269; F04D 11/0008
USPC ..... 417/477.1, 477.3, 477.9, 540
See application file for complete search history.

(56) References Cited

U.S. PATENT DOCUMENTS 922,205 A * 5/1909 Still ..... F04D 13/066 417/475
1,703,361 A * 2/1929 Pohl ..... F04B 43/1276 137/240
2,722,893 A * 11/1955 Maillot ..... F04B 43/021 417/474
6,811,386 B2 * 11/2004 Hedington ..... F04B 43/14 417/474
9,062,672 B2 * 6/2015 Becker ..... A61M 5/1413
2004/0191086 A1 * 9/2004 Paukovits, Jr. ..... F04B 23/026 417/313

(Continued)

FOREIGN PATENT DOCUMENTS

EP 1662142 * 5/2006

OTHER PUBLICATIONS

Authorized officer Harry C. Kim, International Search Report and Written Opinion in PCT/US2017/067969, dated Jan. 25, 2018, 11 pages.

*Primary Examiner* — Charles Freay
(74) *Attorney, Agent, or Firm* — Fish & Richardson P.C.

(57) ABSTRACT

This specification describes technologies relating to a pump for dispensing precise quantities of fluids. In some implementations, a pump includes a pump head including one or more recesses configured to receive one or more corresponding roller elements; and a pump body including an input port, and output port, a first fluid channel, and a second fluid channel, wherein the first fluid channel is formed in part from rigid walls of the pump body and in part from a semi-rigid membrane positioned on at least a portion of the pump body; wherein the pump head is rotatably coupled to the pump body such that the one or more roller elements interface with the semi-rigid membrane such that during rotation the roller elements compress the semi-rigid membrane to push fluid trapped within the first fluid channel in the direction of rotation.

20 Claims, 9 Drawing Sheets

(56) References Cited

U.S. PATENT DOCUMENTS

| | | | | |
|---|---|---|---|---|
| 2011/0184374 | A1* | 7/2011 | Gao | A61M 5/14232<br>604/500 |
| 2014/0356206 | A1* | 12/2014 | Sorensen | F04B 43/1276<br>417/477.7 |
| 2015/0176577 | A1* | 6/2015 | Centofante | F04B 43/12<br>417/477.6 |

* cited by examiner

502

FLUID PUMP WITH PULSE REDUCTION

BACKGROUND

This specification relates to a pump for dispensing fluids.

Many conventional processes require a precise amount of fluids to be dispensed. Fluids e.g., liquids, can be conventionally dispensed in many ways including manual and mechanical pouring from a container to a receptacle. Many conventional techniques for dispensing fluids can have problems, for example, with accuracy and spilling.

SUMMARY

This specification describes technologies relating to a pump for dispensing precise quantities of fluids and methods for assembling the pump.

This specification describes a pump apparatus. The pump can dispense precise amounts of a specified fluid. A variety of fluids can be dispensed including colorants, pigments, oils, detergents, paints, reagents, chemicals, foods, beverages, fuels, inks, adhesives, medical fluids, solutions, solvents, blood, serum, or lactated Ringer's solution.

In general, one innovative aspect of the subject matter described in this specification can be embodied in a system that includes a pump comprising: a pump head including one or more recesses configured to receive one or more corresponding roller elements; and a pump body including an input port, and output port, a first fluid channel, and a second fluid channel, wherein the first fluid channel is formed in part from rigid walls of the pump body and in part from a semi-rigid membrane positioned on at least a portion of the pump body; wherein the pump head is rotatably coupled to the pump body such that the one or more roller elements interface with the semi-rigid membrane such that during rotation the roller elements compress the semi-rigid membrane to push fluid trapped within the first fluid channel in the direction of rotation.

The foregoing and other embodiments can each optionally include one or more of the following features, alone or in combination. In particular, one embodiment includes all the following features in combination. The pump body further comprises a connector that couples the first fluid channel and the second fluid channel, and wherein fluid pushed through the first fluid channel passes through the connector to the second fluid channel. The input port is coupled to the first fluid channel. The output port is coupled to the second fluid channel. The semi-rigid membrane is bonded to the pump body by a bonding material injected into a sealing channel formed in the pump body and thereby enclosing the fluid channel. Only the first fluid channel is driven by the roller elements. The second fluid channel is completely enclosed by rigid sidewalls. The semi-rigid membrane covers both the first fluid channel and the second fluid channel. The walls of the first fluid channel are formed within the pump body are configured to receive the one or more roller components. The rotatable portion further includes: a drive motor configured to cause the rotatable portion to rotate. The system further includes: a controller configured to drive the motor to dispense a specified amount of fluid.

In general, one innovative aspect of the subject matter described in this specification can be embodied in a system that includes a pump head including one or more recesses configured to receive one or more corresponding roller elements; and a pump body including an input port, and output port, a first fluid channel, and a second fluid channel, wherein the first fluid channel is formed in part from rigid walls of the pump body and in part from a semi-rigid membrane positioned on at least a portion of the pump body; wherein the pump head is rotatably coupled to the pump body such that the one or more roller elements interface with the semi-rigid membrane such that during rotation the roller elements compress the semi-rigid membrane to push fluid trapped within the first fluid channel in the direction of rotation.

The foregoing and other embodiments can each optionally include one or more of the following features, alone or in combination. In particular, one embodiment includes all the following features in combination. The pump body further comprises a connector that couples the first fluid channel and the second fluid channel, and wherein fluid pushed through the first fluid channel passes through the connector to the second fluid channel. The input port is coupled to the first fluid channel. The output port is coupled to the second fluid channel. The semi-rigid membrane is bonded to the pump body by a bonding material injected into a sealing channel formed in the pump body and thereby enclosing the fluid channel. Only the first fluid channel is driven by the roller elements. The second fluid channel is completely enclosed by rigid sidewalls. The semi-rigid membrane covers both the first fluid channel and the second fluid channel. The walls of the first fluid channel are formed within the pump body are configured to receive the one or more roller components.

Particular embodiments of the subject matter described in this specification can be implemented so as to realize one or more of the following advantages. Precise amounts of fluids can be dispensed in a controlled manner. A dispensed amount can be controlled based on an amount of pump rotation e.g., based on time or degrees of rotation. The pump can be stand alone and connected to various containers for storage and discharge through tubing or it can be integrated with a fluid container to provide a single disposable pump and container combination. This can provide for a sealed environment as well as reducing leaks and contamination. The pump can be formed from plastic materials and assembled using, for example, sonic welding, laser welding, adhesive bonding, multiple shot molding, or snap fits. The pump is self-priming. The pump is also reversible such that the flow can be reversed with the same precision as the dispensing rotational direction. The pump does not contain any valves for trouble free operation. The pump can include a secondary fluid channel configured to reduce a pulsing effect generated by the pumping.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
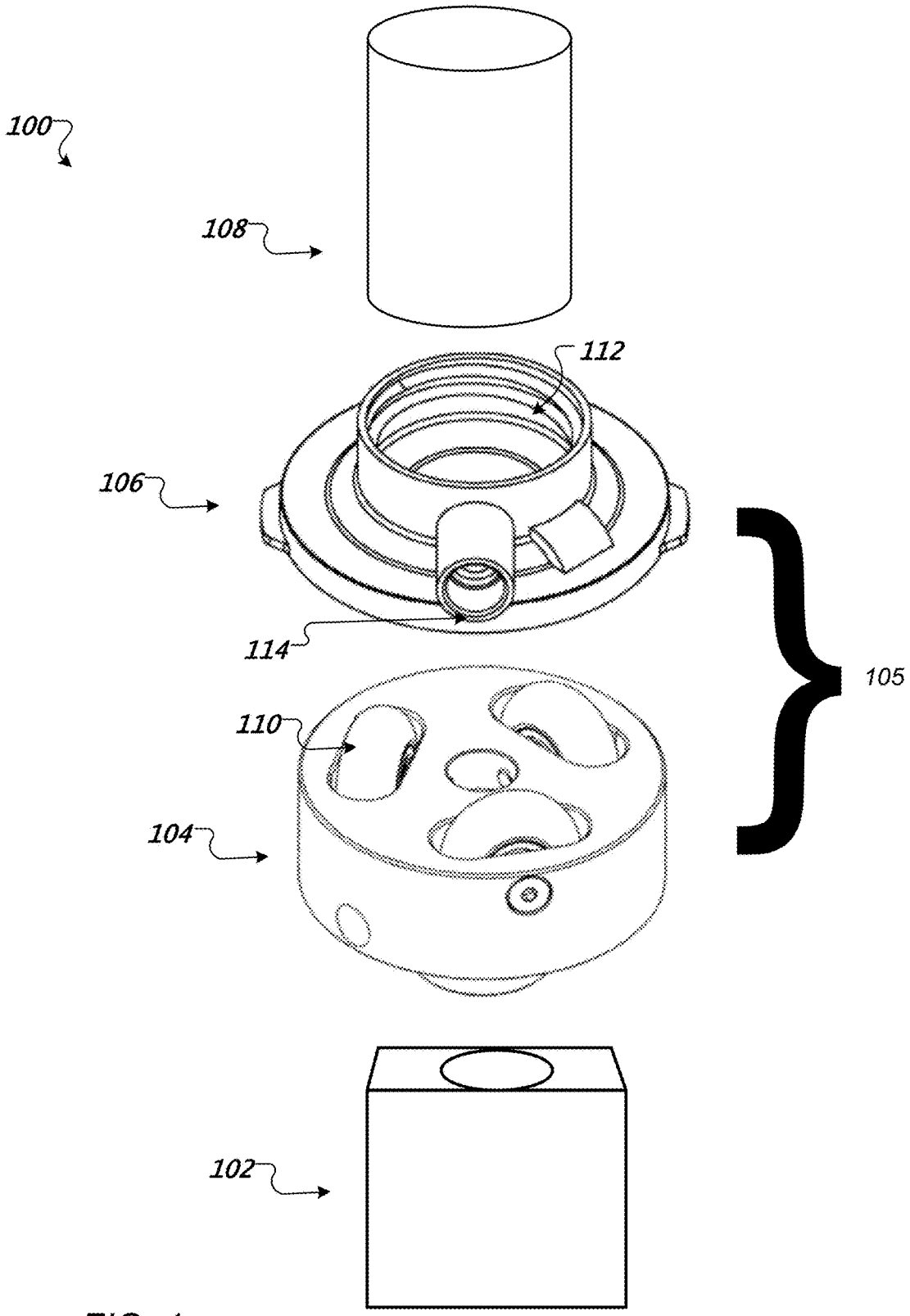
FIG. 1 shows an example pumping system.

FIG. 1 shows an example pumping system 100. The pumping system 100 includes a drive motor 102, a pump head 104, a pump body 106, and a fluid container 108. The pump head 104 and pump body 106 combine to form a fluid pump 105. The drive motor 102 is configured to drive a rotation of the pump head 104, which in combination with the pump body 106 causes fluid pumping. The drive motor 102 can be an electric motor, e.g., a stepper motor, linear motor, or electric actuator configured to drive a rotational driveshaft that engages the pump head 104, for example, the drive motor 102 can drive a rotational portion that is configured to couple to the pump head 104 in order to translate the rotational energy of the drive motor 102 to the pump head 104. In some implementations, the pump motor 102 includes one or more recesses that are configured to be engaged by one or more protrusions of the pump head 104 such that rotation of the pump motor 102 causes rotation of the pump head 104. Any other suitable form of coupling can be used. In some implementation, additional latching structures can be included to secure the pump head 104 to the drive motor 102.

The drive motor 102 can include, or be communicatively coupled to, a programmable controller such that particular commands can be input to pump a specified amount of fluid according to the command The controller can calculate motor driving time based on a specific flow rate of the fluid pump 105 for a given rate of rotation. The flow for the fluid pump 105 can be based on an amount of rotation of the fluid pump 105. For example, the amount of fluid dispensed per degree of rotation can be calculated for various fluids. The amount of fluid dispensed per degree of rotation can vary for different fluids, in particular, for varying viscosity. The relationship between rotation and fluid dispensed can be determined empirically for different fluids.

To dispense a specified amount of a given fluid, a command can be issued to drive the drive motor 102 so that the pump head 104 is rotated by a particular amount. The command can be issued based on the type of fluid and the amount to be dispensed. In some implementations, the drive motor 102 is designed to dispense a single fluid. In such scenarios, the amount of rotation to dispense a specified amount of fluid is fixed. In some other implementations, the motor is designed to dispense different fluids. In such scenarios, a particular fluid can be specified so that the correct amount of rotation is determined for a given amount of that fluid to be dispensed.

In some other implementations, the amount of fluid dispensed can be determined according to a weight of the fluid dispensed. For example, one command can cause the drive motor 102 to operate such that one gram of fluid is dispensed. A second command can cause the drive motor 102 to dispense two grams of fluid. In each case, a scale measuring a dispensed amount of fluid can be coupled to the drive motor 102 such that when the pump is stopped when a specified weight of dispensed fluid is attained. Thus, a particular liquid can be dispensed in different amounts depending on the application. In some other implementations, motor commands are calibrated to dispense a particular fluid volume rather than weight, e.g., [x] number of milliliters.

The pumping system 100 can include an interface (not shown) for entering commands, e.g., for particular liquid dispensing. For example, one or more interface controls can allow the user to specify a particular command using menus, command codes, or a combination of both, e.g., using buttons, touch screen interface, or other input. The drive motor 102 can then receive signals to operate in response to the interface commands.

In some implementations, the drive motor 102 is coupled to another device that provides a control interface, for example, a computing device. The computing device can include software for both controlling the drive motor 102 and providing a user interface. The user interface can allow the user to provide commands for dispensing liquids.

In some other alternative implementations, the drive motor 102 can be manually controlled, for example, when less precision is necessary. The drive motor 102 can simply include an activation control that the user can manually use to start and stop the drive motor 102. For example, the user can be provided with a flow rate for one or more fluids with respect to time of motor operation. The user can then calculate the time needed to operate the drive motor 102 in order to manually dispense the desired amount.

The pump head 104 rotates in a corresponding response to the drive motor 102. In some implementations it is configured to operate in both a forward and reverse direction such that the fluid pump 105 can operate bidirectional. The pump head 104 includes one or more roller elements 110. Each roller element is configured to interface with a semi-rigid membrane of the pump body 106 to push fluid through a pump channel, as described in greater detail below.

The pump body 106 includes a fluid channel formed from a rigid surface of the pump body 106 and enclosed using the semi-rigid membrane. In the example pump system 100, fluid from the fluid container 108 enters an intake portion 112 of the pump body 106 into the fluid channel. The pump head 104 drives the fluid through the fluid channel to an output port 114. In some implementations, instead of a direct couple to the fluid container, the pump body 106 includes an input port and an output port positioned on the pump body 106. The input port can be coupled to a separate fluid container, for example, using one or more tubes. Similarly, the output port can be coupled to a tube used to direct the dispensed fluid to a particular location, e.g., another container.

As shown in FIG. 1, the fluid container 108 is removable from the pump body 106, e.g., using threads to screw or unscrew the fluid container 108 and pump body 106. In some other implementations, the fluid container 108 and the pump body 106 form a single use integrated package joined, e.g., using sonic welding. The fluid container 108 and pump body 106 can be oriented such that the fluid in the container is gravity fed to the pump. As a result, the fluid pump 105 may not require priming before operation.

The fluid container 108 can include a vent or one-way valve allowing fluid to be dispensed using the fluid pump 105 without creating a vacuum. In some implementations, the fluid container 108 is configured with as a bag within a bag. In particular, a rigid or semi-rigid outer container can provide a specified form factor. An inner collapsible container can be positioned within the outer container. As fluid is dispensed, the inner container can collapse in on itself. In some implementations, plastic preforms can be molded to provide the inner and outer containers. Stretch blow molding can be used to expand the preform to form the fluid container 108. The fluid container 108 can be blow molded from an eva resin, e.g., Elvax®, to form a very flexible but durable container.

The fluid container 108 can provide a sealed fluid container that provides air tight dispensing. This can reduce the risk of contamination to the fluid. For example, some fluids react to oxygen, e.g., liquids that cure when exposed to air. Other fluids can easily be contaminated by particulates in the air resulting which can impair their function and also interfere with the dispensing. The fluid container 108 can be composed of various flexible materials, for example, low density polyethylene.

FIGS. 2A-D show example views of a pump head 200, e.g., similar to pump head 104 of FIG. 1.

Figure 2A:
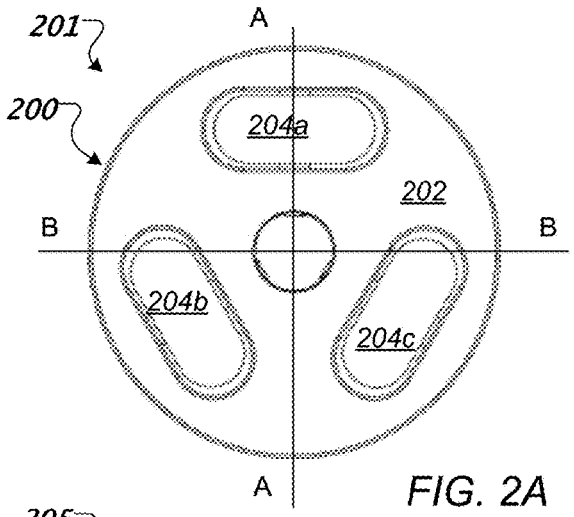
FIGS. 2A-D show example views of a pump head.

FIG. 2A shows a top view 201 of the pump head 200. The top view 201 illustrates a top surface 202 of a body of the pump head 200 and three roller elements 204*a*, 204*b*, and 204*c*. The body of the pump head 200 can be molded, e.g., from a plastic material. Alternatively, the pump head 200 can be formed from metal and/or plastic to form a durable multi-use component that can be coupled to successive pump bodies. The top surface 202 can be substantially disk shaped and sized to couple with a pump body (e.g., pump body 106). The outer circumference of the top surface 202 may include an edge or other structure configured to form a seal against the pump body. In some implementations, a retaining ring or other suitable attachment structure is used to couple the pump head 200 to the pump body in a manner that allows the pump head 200 to rotate relative to the pump body.

The roller elements 204*a*, 204*b*, and 204*c* are positioned in the pump head 200 so that when the pump head 200 is coupled to the pump body, the roller elements exert compressive force on a semi-rigid membrane of the pump body relative to a fluid channel formed in the pump body. For example, the roller elements 204*a*, 204*b*, and 204*c* can be configured to traverse a fluid channel formed in the pump body during rotation such that the semi-rigid membrane is compressed into the fluid channel, substantially blocking off the fluid channel at the points of contact with the roller element. As shown in FIG. 2A, the roller elements are wheel shaped. However, other suitable roller elements can be used including spherical elements, cylindrical elements, or other suitable geometry.

Figure 2B:
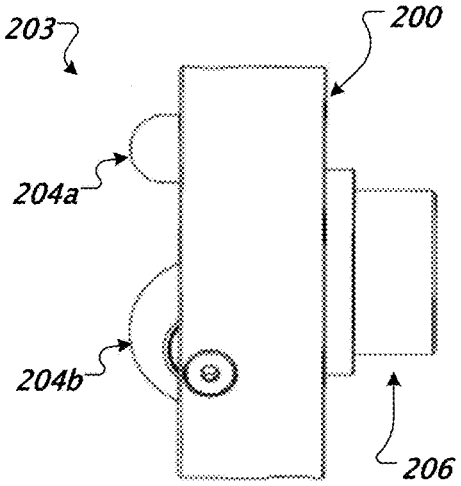
Figure 2C:
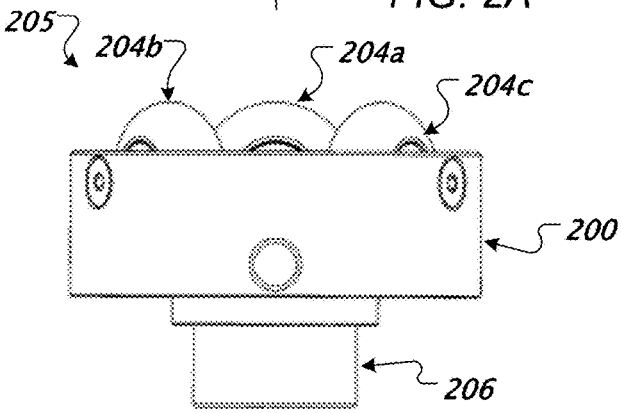

FIGS. 2B and 2C show side views 203 and 205, respectively, of the pump head 200. In particular, FIG. 2B illustrates side view 203 corresponding to the pump head 200 of FIG. 2A rotated along axis A while FIG. 2C illustrates side view 205 corresponding to the pump head 200 of FIG. 2A rotated along axis B. The respective side views illustrate that the roller elements 204*a-c* are at least partially embedded within the body of the pump head 200. In some implementations, the body of the pump head is molded to include recesses for receiving the roller elements 204*a-c*. The recesses maintain the position of the roller elements relative to the pump head 200. Thus, as the pump head 200 rotates relative to the pump body, the respective roller elements move with the corresponding recesses. In some implementations, the recesses and roller elements are configured to allow the roller elements to rotate as the pump head is turned.

In some alternative implementations, the recesses and roller elements can be replaced with molded elements having a fixed position on the rotatable portion. These molded elements, for example, hemispherical shaped protrusions, would move along with the pump head.

Figure 2D:
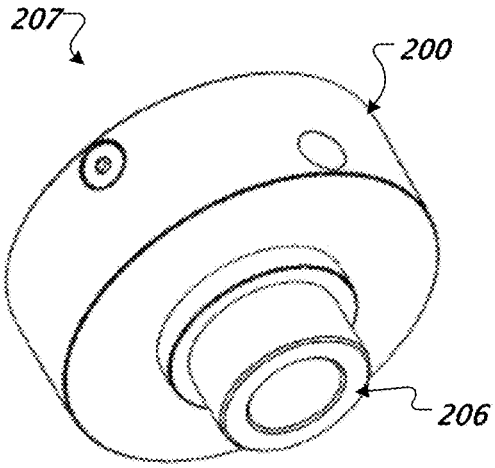

The side views also illustrate a coupling portion 206 for coupling the pump head to a motor, e.g., drive motor 202. In some implementations, the coupling portion can include two or more protrusions rather than a single one to help prevent slippage during rotation. FIG. 2D shows a bottom view 207 of the pump head 200. The bottom view 207 illustrates the coupling portion 206 relative to the pump body.

Figure 3A:
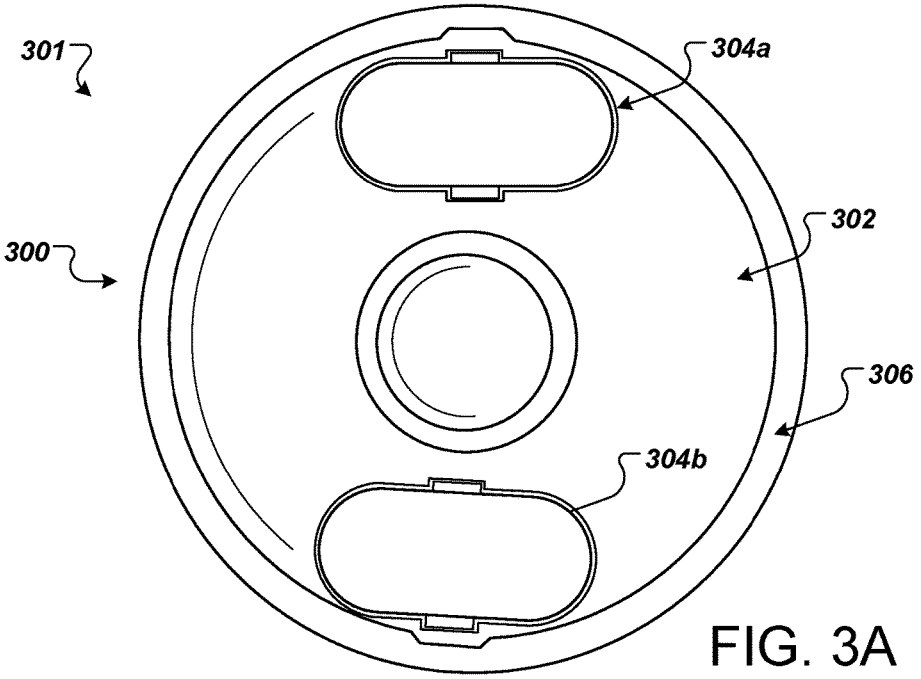
FIGS. 3A-B show example views of another pump head.
Figure 3B:
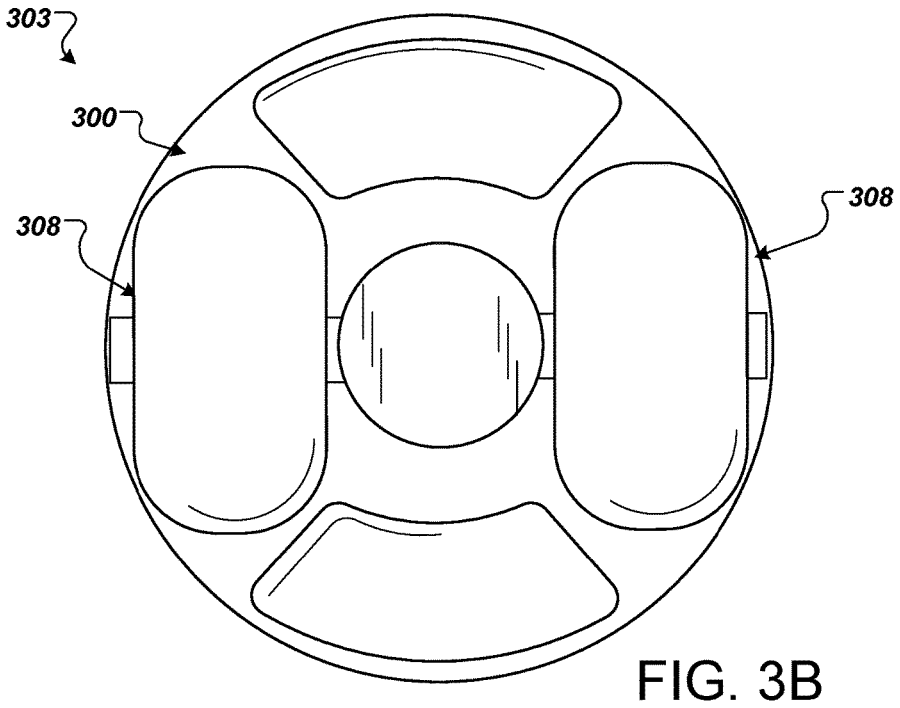

FIGS. 3A-B illustrate another example pump head 300. FIG. 3A shows a top view 301 of the pump head 300. The top view 301 illustrates a top surface 302 of a body of the pump head 300 and two roller elements 304*a* and 304*b*. The body of the pump head 300 can be molded, e.g., from a plastic material. The top surface 302 can be substantially disk shaped and sized to fit with a pump body (e.g., pump body 106). The outer circumference of the top surface 302 may include an edge or other structure configured to facilitate coupling and/or form a seal against the pump body. In particular, FIG. 3A shows a raised lip structure 306 surrounding the circumference of the top surface 302 of the body of the pump head 302.

FIG. 3B shows a bottom view 303 of the pump head 300. The bottom view 303 illustrates an example of two protrusions 308 corresponding to the coupling portion of the pump body for coupling the pump body to the drive motor. In some implementations, these protrusions double as the molded form of the recess portions used for the roller elements 304*a* and 304*b*. This allows the pump head 300 to be smaller and use less material.

Figure 4A:
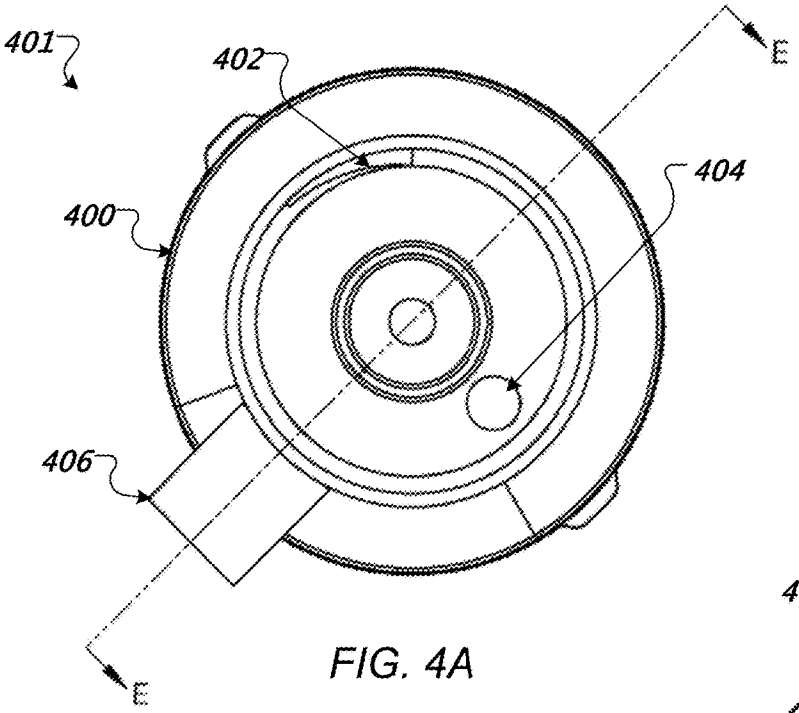
FIGS. 4A-D show example views of a pump body.

FIGS. 4A-D show example views of a pump body 400. FIG. 4A shows a top view 401 of the pump body 400. The pump body 400 can be similar to pump body 106 of FIG. 1. The pump body 400 includes threads 402 for coupling a fluid container to the pump body 400. The threads are configured to receive a fluid container having an opening of a particular diameter. The pump body 400 also includes an input port, for example positioned as input port 404 and an output port 406. The locations of the ports can vary as suitable for particular applications. The input port 404 is configured to receive fluid from the fluid container and to pass the fluid from the fluid container into a fluid channel formed in the pump body. The fluid channel is coupled to the output port 406 for passing fluid from the fluid channel out of the pump body 400 in response to a pumping operation.

Figure 4B:
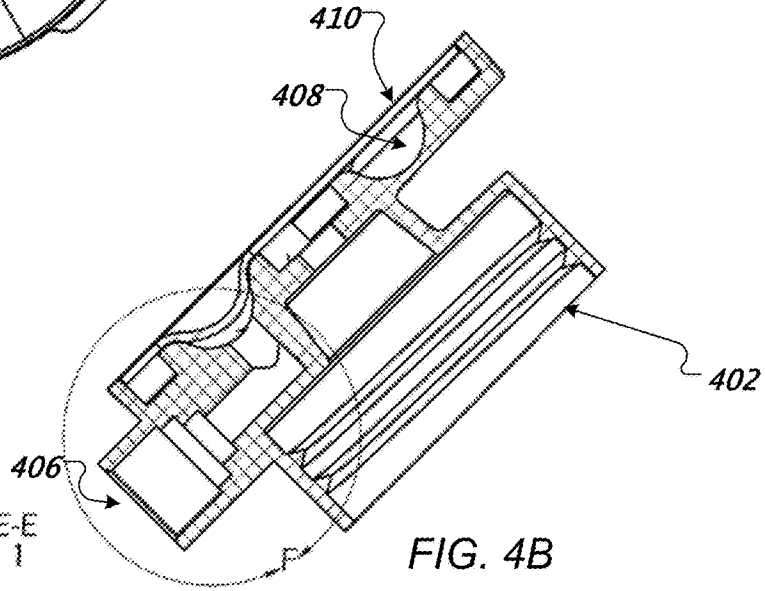

FIG. 4B shows a cross-sectional view 403 of the pump body 400 along axis E. The cross-sectional view 403 illustrates the output port 406 coupled to a fluid channel 408. The path of the input port 404 to the fluid channel is not visible in this cross-section. The cross-sectional view 403 also shows a semi-rigid membrane 410. In particular, the fluid channel 408 is formed from a rigid surface of the pump body 400 and the semi-rigid membrane 410. For example, the fluid channel 408 can be a channel that includes a u-shaped cross-section formed form a rigid plastic material of the pump body 400 topped by the semi-rigid membrane 410. Thus, a fluid passing through the fluid channel 408 passes within the channel formed by the rigid walls of the pump body 400 and the semi-rigid membrane 410, e.g., meaning that the fluid is in direct contact with the walls of the pump body and a surface of the semi-rigid membrane. The fluid channel can follow a route through the pump body 400 from the input port 404 to the output port 406.

Figure 4C:
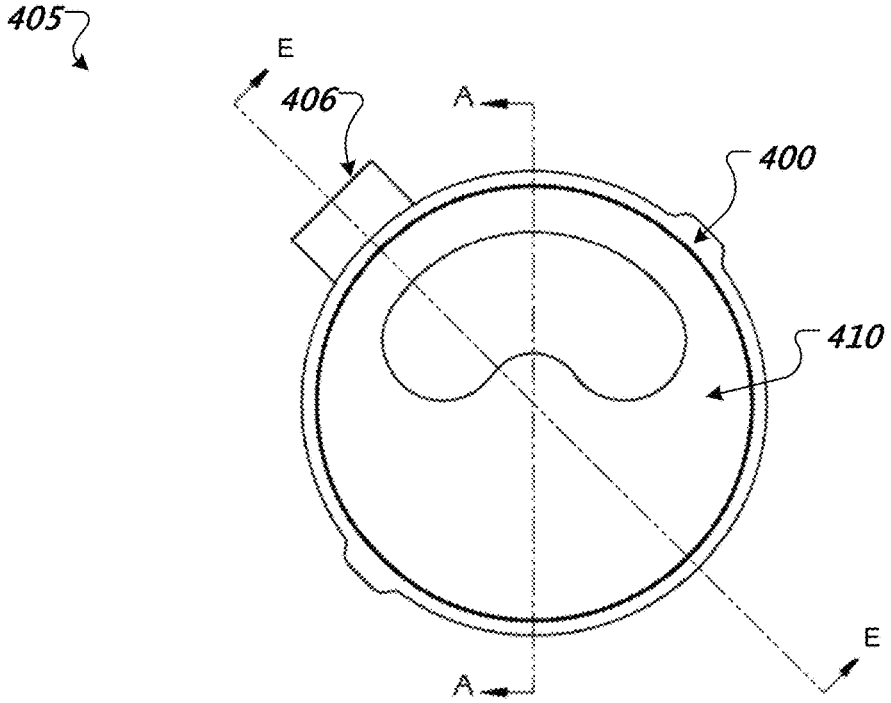

FIG. 4C shows a bottom view 405 of the pump body 400. The bottom view illustrates the semi-rigid membrane 410 overlaying a portion of the pump body 400 and covering the fluid channel 408. In some implementations, the semi-rigid membrane 410 is bonded to the pump body 400 through an injection of a bonding material that engages the surface of the semi-rigid membrane 410 and the pump body 400 at particular locations. Bonding the semi-rigid membrane 410 to the pump body 400 is described in greater detail below with respect to FIGS. 5-7.

Figure 4D:
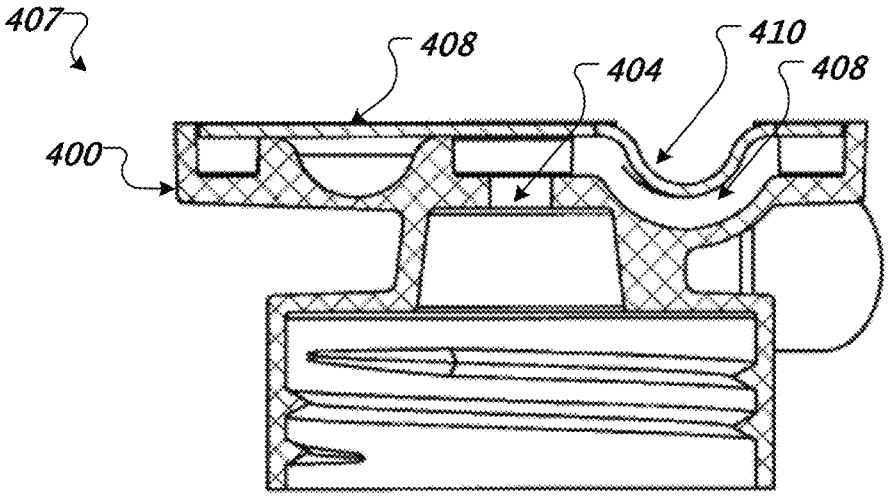

FIG. 4D shows a cross-sectional view 407 of the pump body 400 along axis A. In particular, the cross-sectional view 407 illustrates an input path for the input port 404 to the fluid channel 408. Fluid enters the fluid channel 408 through the input port 404. The fluid can be pumped to the output port 406, for example, by rotating the pump head, e.g., pump head 200. In particular, the rolling elements of the pump head can compress the semi-rigid membrane 410 into the fluid channel 408. As the rolling elements traverse the fluid channel 408 due to rotation of the pump head, the progressive compression of the semi-rigid membrane 410 pushes the fluid in the fluid channel 408 toward the output port 406.

While FIG. 4 shows an example of a pump body where a fluid container is attached directly, other configurations can include an input port only without coupling of the fluid container itself to the pump body. For example, the top surface can include separate input and output ports communicatively coupled to the fluid channel formed in the pump body. An example of this type of pump body is shown with respect to FIGS. 5-6.

Figure 5:
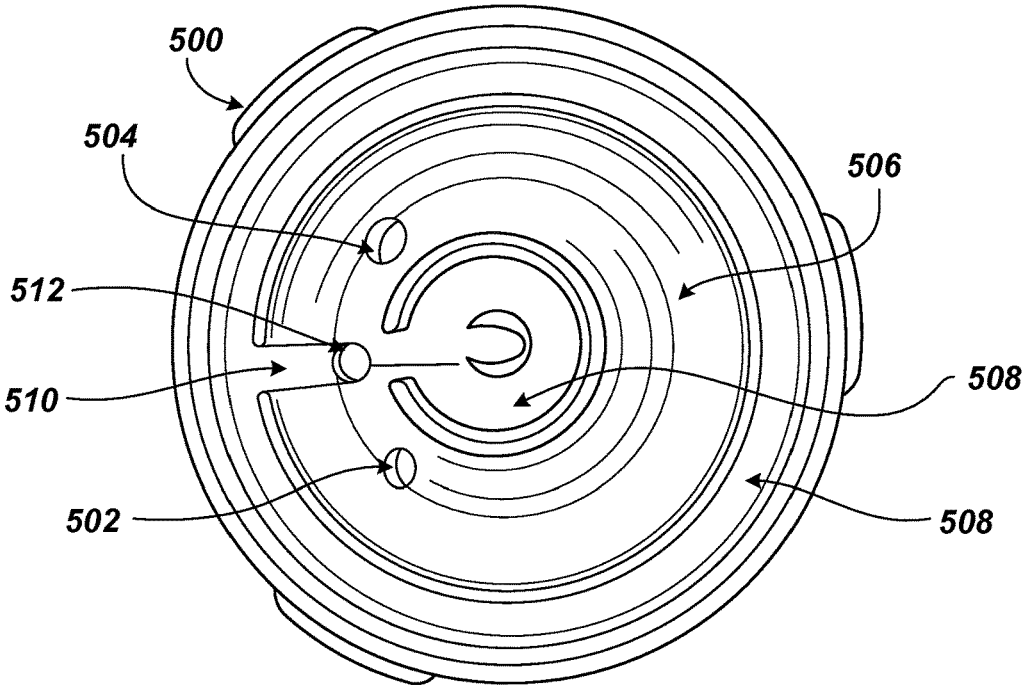
FIG. 5 shows an example pump body illustrating a pump channel without flexible membrane.

FIG. 5 shows an example pump body 500 illustrating a pump channel without a semi-rigid membrane in place. As shown from a view similar to that of FIG. 4C, the pump body 500 includes an input port 502, and output port 504, and a fluid channel 506. The input port 502 and the output port 504 are coupled to the fluid channel 506. The fluid channel 506 can be formed in the pump body 500 during manufacture, for example, the pump body 500 can be molded as a single piece of plastic. The fluid channel 506 is configured to provide a fluid pumping around the pump body 500 from the input port 502 to the output port 504. In some implementations, the pump can operate in a reverse direction around the pump body 500. The fluid channel 506 is formed of the rigid material of the pump body 500 and is sized to provide a particular flow rate. Additionally, roller elements, described above, are configured along with the fluid channel 506 such that the roller component close off the flow of fluid through the fluid channel at each point in which a roller element compresses the semi-rigid membrane into the fluid channel.

The pump body 500 also includes a sealing channel 508. The sealing channel is used to seal the semi-rigid membrane to the pump body 500, forming a final portion of the fluid channel. The sealing channel 508, as shown, encircles an outer circumference of the pump body 500 as well as a center portion. Additionally, a connecting portion 510 of the sealing channel 508 joins the center portion and the outer circumference portion of the sealing channel 508. When the semi-rigid membrane is in position, a bonding material can be injected into the sealing channel 508 such that it flows to all points in the sealing channel 508 bonding to both the semi-rigid membrane and the pump body 500. Sealing the portion of the connecting portion 510 separates the input port 502 and the output port 504 such that pumped fluid flows through the fluid channel 506 a long distance arc around the pump body 500. The sealing material can be injected into the sealing channel 508 through one or more ports, for example, sealing port 512.

Figure 6:
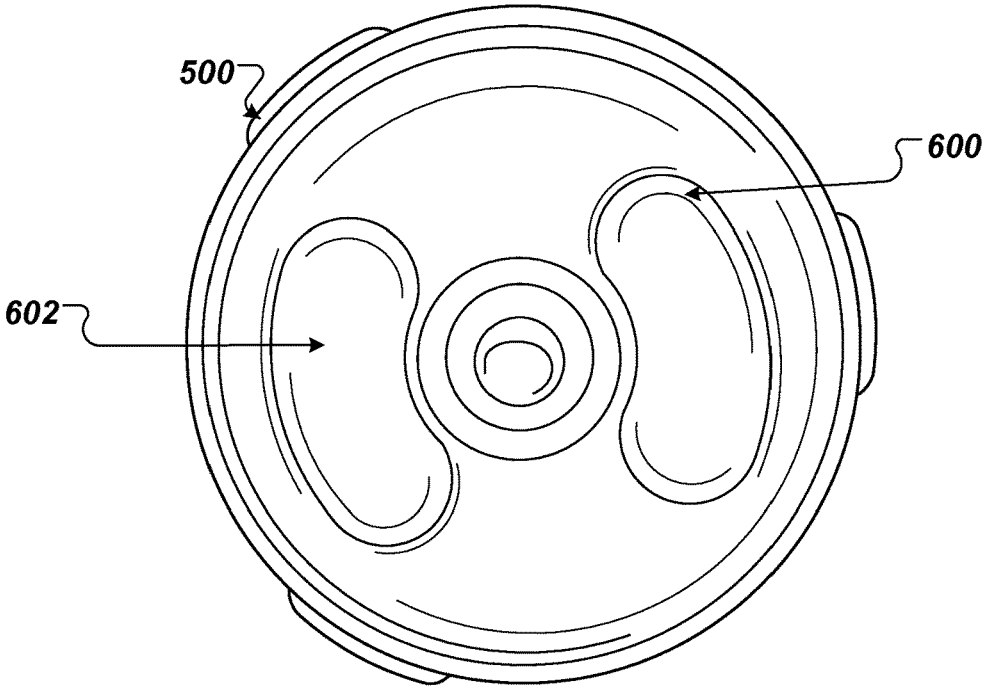
FIG. 6 shows the example pump body of FIG. 4 including the semi-rigid membrane.

FIG. 6 shows the example pump body 500 of FIG. 5 including the semi-rigid membrane 600. The semi-rigid membrane 600 is positioned over the pump body 500 to enclose the fluid channel 506 such that fluid bounded by the semi-rigid membrane 600 and the rigid fluid channel 506 can flow from the input port to the output port. A depression 602 in the semi-rigid membrane 600 corresponds to the sealed portion between the input port 502 and the output port 504 sealed by connecting portion 510. The semi-rigid membrane 600 is further bonded to the pump body at the points of the sealing channel 508. The semi-rigid membrane 600 is configured to interface with the one or more roller elements of the pump head, e.g., pump head 200. The semi-rigid membrane 600 is compressible by the roller elements of the pump head to block off points of the fluid channel 506 to form a substantially fluid tight seal and to push fluid through the fluid channel 506 in response to rotation of the pump head. The semi-rigid membrane 600 can be formed from santoprene, polyurethane, silicone, or any other flexible material including, cloth, plastics, or metals.

Figure 7:
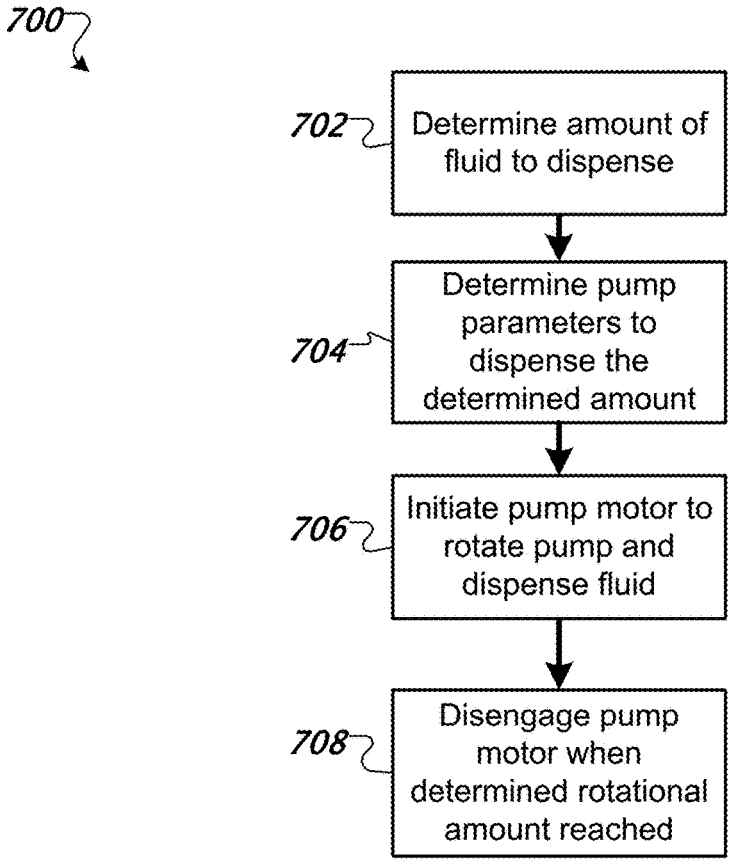
FIG. 7 shows a flow diagram of an example process for fluid pumping.

FIG. 7 shows a flow diagram of an example process 700 for pumping fluid. For convenience, the process 700 will be described with respect to a pumping system that performs the process 700, e.g., pumping system 100 of FIG. 1.

The pumping system determines an amount of fluid to dispense 702. In some implementations, a specified volume about is input to the pumping system. For example, a user can input a specified volume, e.g., in ounces or milliliters, to a control of the pumping system. In some other implementations, a specified weight is input to the pumping system. The pumping system can include a scale that is coupled to a pump control such that the pump can be controlled in response to a measured weight.

In some other implementations, the amount of fluid to dispense is determined based on a specified operation. For example, particular operations can be associated with respective predefined fluid amounts corresponding to different operations. When a command is received to perform a specified operation, the system determines the amount of fluid to dispense for that operation.

The system determines one or more pumping parameters to dispense the determined amount 704. In some implementations, a pumping parameter is a specified amount of pumping time. The pumping time can be based on a known flow rate for a given fluid being dispensed. Different fluids can have different flow rates through the pump system as a function of time depending on the speed of the pump rotation. Therefore, in some implementations, the fluid is specified along with the amount to dispense so that the system can determine the pumping time given the amount of fluid and the flow rate for that fluid.

In some implementations, the pumping parameter is a specified rotational amount. The flow rate for a particular fluid can be specified in terms of amount per unit of rotation, e.g., amount per degree of rotation. Thus, for a given amount of a particular fluid, the system can determine the number of degrees of rotation to dispense the amount.

The system initiates a pump motor to rotate a pump head (e.g., pump head 200) and dispense fluid 706. For example, a controller of the pump system can activate a pump motor which in turn drives a rotation of the pump head. As the pump head rotates, as driven by the pump motor, fluid is pumped from a fluid container coupled to an input port to an output port. The motor rotates a drive shaft that causes a corresponding rotation of the pump (e.g., the pump head) such that precise amounts of fluid are dispensed as a function of the motor speed, pump configuration, and the fluid being dispensed. In particular, as described above, rotation of the pump head engages roller elements with the semi-rigid membrane such that the fluid channel is compressed as the pump head rotates, thereby pushing fluid through the fluid channel from the input port to the output port.

The system disengages the pump motor when determined amount of fluid is dispensed 708. Once the determined amount of fluid has been dispensed, the system can stop the pump motor there thereby stop the rotation of the pump head. When the dispensed amount is determined based on a rotational amount or pumping time, the system can disengage the pump motor when the determined time or rotation has occurred. When the dispensed amount is determined based on a weight of dispensed fluid, the system can disengage the pump motor when the weight measured by the scale has been reached. Alternatively, the system can be calibrated to account for any residual fluid between the pump output and the destination (e.g., in a dispensing tube) that will be released so that substantially the exact amount of fluid is dispensed once the motor is deactivated. The motor can then be disengaged and the pump stopped prior to the determined weight being reached such that the residual fluid will bring the total weight to the determined amount.

The dispensed liquid can then be used for various applications. The fluid pump can be used to dispense fluids for use in a variety of processing including extrusion, blow molding, or film production. In particular, liquid colorants can be used to color various products (e.g., bottles). In some other implementations, the fluid pump can be used to dispense colorants for the coloring of waxes for candles and wine bottle seals, to dispense catalysts for thermoset plastics, and to dispense single and multiple component adhesives and sealants.

Figure 8:
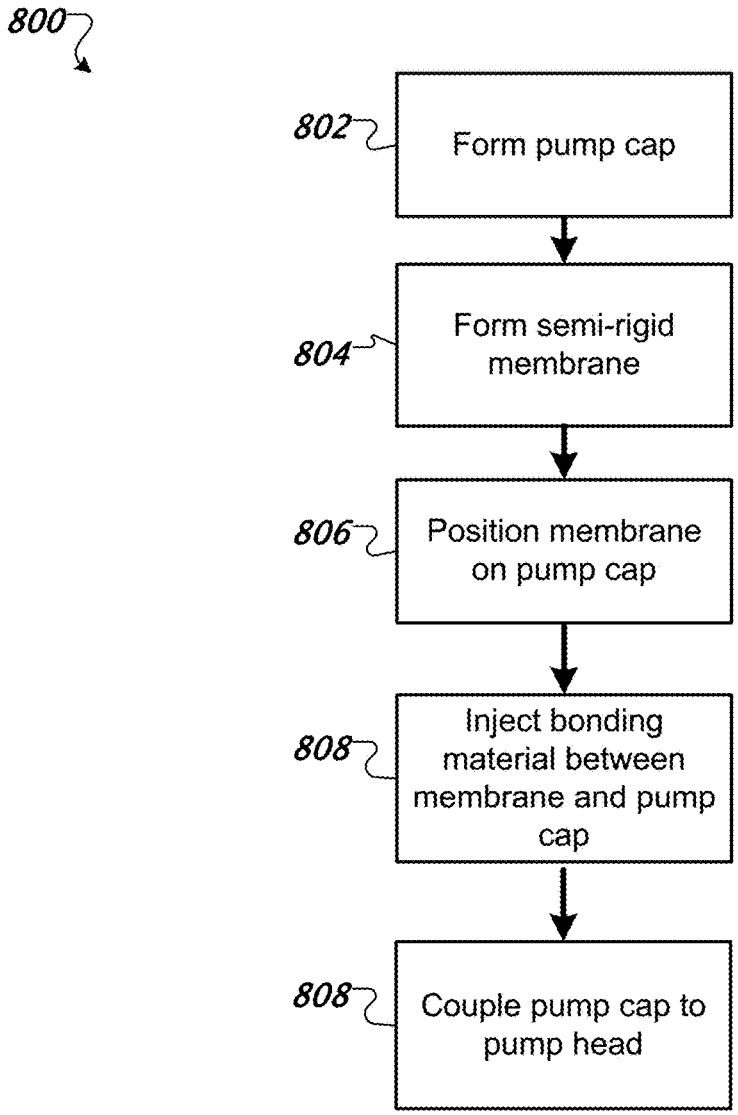
FIG. 8 shows a flow diagram of an example process for manufacturing a fluid pump.

FIG. 8 shows a flow diagram 800 of an example process for manufacturing a fluid pump, e.g., fluid pump 105. A pump body is formed (step 802). For example, the pump body, e.g., pump body 400 or 500, can be formed through an injection molding process.

A semi-rigid membrane is formed (step 804). The semi-rigid membrane, e.g., semi-rigid membrane 410 or 600, can be molded from a suitable material. The mold can provide a shape of the semi-rigid membrane configure to fit within an area of the pump body. In particular, the semi-rigid membrane can be shaped to include an indented portion to aid in bonding the semi-rigid membrane to the pump body.

The semi-rigid membrane is positioned on the pump body (step 806). The semi-rigid membrane is positioned such that a portion of the semi-rigid membrane covers a top of a fluid channel formed in the pump body.

A bonding material is injected between the semi-rigid membrane and the pump body (step 808). The bonding material can be injected into a sealing channel formed in the pump body (e.g., sealing channel 508). The bonding material can bond the semi-rigid membrane to the pump body such that fluid entering an input port of the pump body can only move through the fluid channel to an output port. Additionally, the bonding material can form a seal between the input and output ports so that the fluid can't backflow from one to the other. For example, the fluid channel can be an arc formed in the pump body that nearly forms a circle from the input port to the output port. The sealed portion in the short distance between the input and the output port can ensure fluid flow through the length of the arc. The bonding material can bond the semi-rigid membrane and the pump body on both an outside and an inside of the fluid channel (e.g., as shown in FIG. 5), so that the semi-rigid membrane encloses the fluid channel.

The pump body is coupled to a pump head (step 808). The pump head, e.g., pump head 200, can include one or more roller elements that engage with the semi-rigid membrane when coupled to the pump body. The pump head is rotatable coupled to the pump body so that the pump head can rotate relative to the pump body to pump fluid through the fluid channel.

The rotation of the rolling elements of the pump head causes breaks in the fluid flow through the fluid channel, which can result in a pulsing effect on the fluid output through the output port.

Figure 9A:
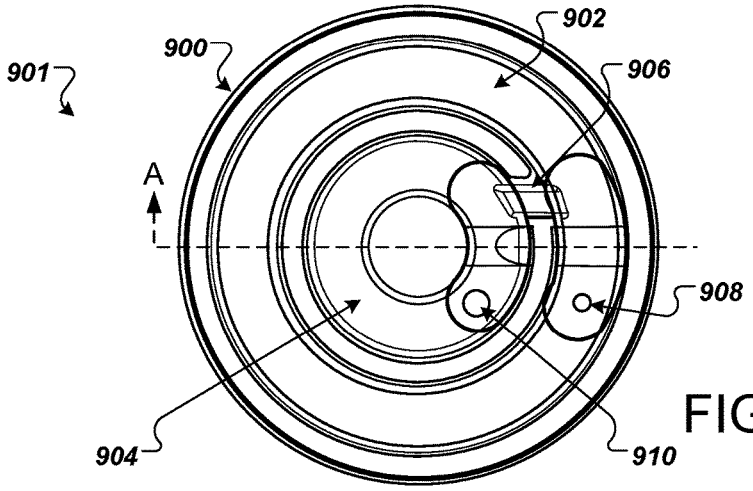
FIGS. 9A-C illustrate a pump body including a pulse reducing channel.
Figure 9B:
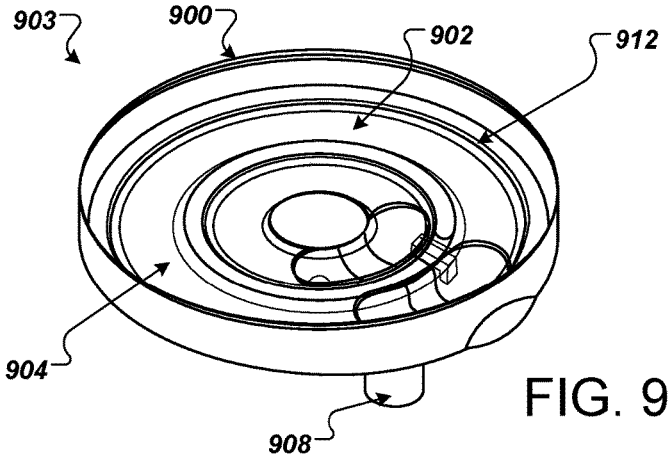
Figure 9C:
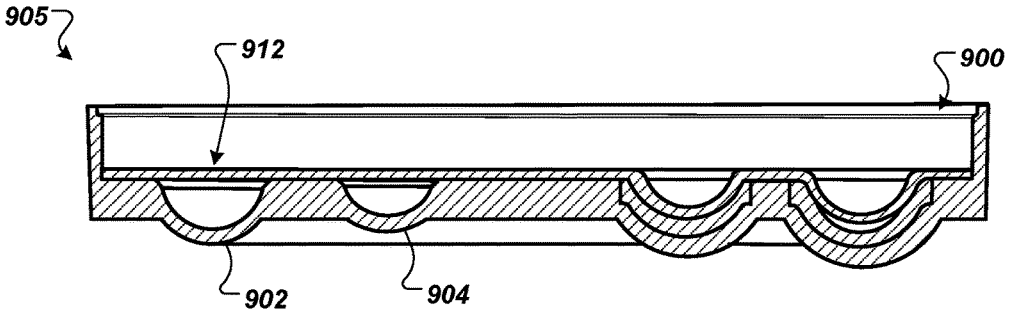

FIGS. 9A-C illustrate a pump body 900 including a pulse reducing channel. FIG. 9A shows a top view 901 of the pump body 900. FIG. 9B shows an angled view 903 of the pump body 900, and FIG. 9C shows a cross-sectional view 905 along line A of FIG. 9A.

In particular, the pump body 900 includes a first fluid channel 902 and a second fluid channel 904 coupled by a connector 906. However, only the first fluid channel 902 is driven by the pump head.

Fluid enters the pump body 900 through input port 908. During pumping, the roller elements of the pump head rotate to push the fluid through the first fluid channel 902. The fluid is pumped to an end point of the fluid channel near the connector 906. The fluid then flows into the second fluid channel 904. The fluid is pushed by pressure of the fluid being pumped through the first fluid channel 902 through the second fluid channel 904 to an output port 910.

Other than the addition of the second fluid channel 904, the structure of the pump body is similar to those described above. The pump body can be formed of a rigid material. For example, the pump body 900 can be formed of an injection molded thermoplastic where the mold forms the shape of the fluid channels and connector. Although not shown, the pump body can include one or more sealing channels that bonds the pump body to a semi-rigid membrane 912 and separates the individual fluid channels from each other except for the connector path.

The semi-rigid membrane 912 can be formed in a similar manner to the example semi-rigid membranes described above. The semi-rigid membrane 912 may be larger to accommodate the larger diameter pump body resulting from the dual fluid channels. The semi-rigid membrane 912 can be configured to cover both fluid channels and the connector in a similar manner as previously described such that each fluid channel and connector includes a rigid portion formed by the pump body 900 and the semi-rigid membrane 912.

In some alternative implementations, since only the first fluid channel 902 is driven by the pump head, the second fluid channel 904 can be completely encased in the pump body or a rigid material can be affixed to cover the second fluid channel 904, e.g., by an adhesive or sonic welding. Thus, for example, the semi-rigid membrane may be a ring shape that covers the first fluid channel 902 and a rigid inner disk may cover the second fluid channel 904.

The one or more sealing channels can be independent or connected to each other and the pump body can include one or more sealing ports for injecting a bonding material into the respective sealing channel.

In some implementations, the fluid channel that is driven by the roller elements can be reversed. For example, instead of driving fluid through the first fluid channel 902, the fluid in the second fluid channel 904 is driven by correspondingly positioned roller elements. In other words, the either fluid channel ring can be driven by adjusting the pump head such that the radius from the center to each roller element matches the appropriate fluid channel being driven by that pump implementation. Alternatively, or in combination, the input and output ports 908 and 910 can be reversed. The particular configuration can depend on the particular application and performance parameters for the fluid pump.

In some implementations, a standalone pulse dampener can be formed that is similar to the pump body 900. While the structure of the two fluid channels and input/output ports can correspond to the pump body 900, the standalone pulse dampener is non driven. Therefore, the pump body 900 can be sealed with a rigid material, e.g., plastic, that takes the place of the flexible membrane. In operation, a fluid is pumped into the input port e.g., using a similar pump to those described or a conventional pump including peristaltic pumps that results in a pulsing output. The pulsed output is pumped into the fluid channels of the pulse dampener and the output port releases pulse dampened fluid.

The operations described in this specification, in particular, processing commands for a motor to drive a pump to dispense a specified amount of fluid, e.g., by a controller, can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program can be deployed to be executed on one computer or on multiple computers that are located at one site or distributed across multiple sites and interconnected by a communication network.

Alternatively, or in addition, the program instructions can be encoded on a computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A system comprising:

a pump comprising:

a pump head including one or more recesses configured to receive one or more corresponding roller elements; and a pump body including an input port, and output port, a first fluid channel, and a second fluid channel, wherein the first fluid channel is defined in part by first rigid walls of the pump body and the second fluid channel is defined in part by second rigid walls of the pump body, wherein the first and second fluid channels form concentric arcs such that the first fluid channel substantially encircles the second fluid channel, and wherein the respective rigid walls of the first and second fluid channels being substantially in the same plane of the pump body; and a semi-rigid membrane positioned on at least a portion of the pump body to enclose the first rigid walls to form the first fluid channel and to enclose the second rigid walls to form the second fluid channel, and wherein the input port is formed by an aperture in the pump body perpendicular to a path of the first fluid channel and the output port is formed by an aperture in the pump body perpendicular to a path of the second fluid channel;

wherein the pump head is rotatably coupled to the pump body such that the one or more roller elements interface with the semi-rigid membrane such that during rotation the roller elements compress the semi-rigid membrane to push fluid trapped within the first fluid channel, the fluid bounded within a region formed by the first rigid walls of the pump body and the semi-rigid membrane, in the direction of rotation and wherein fluid pushed through the first fluid channel passes to the second fluid channel, and wherein fluid in the second fluid channel passes to the output port.

2. The system of claim 1, wherein the pump body further comprises a connector that couples the first fluid channel and the second fluid channel, and wherein fluid pushed through the first fluid channel passes through the connector to the second fluid channel.

3. The system of claim 1, wherein the input port is coupled to the first fluid channel.

4. The system of claim 1, wherein the output port is coupled to the second fluid channel.

5. The system of claim 1, wherein the semi-rigid membrane is bonded to the pump body by a bonding material injected into a sealing channel formed in the pump body and thereby enclosing the fluid channel.

6. The system of claim 1, wherein only the first fluid channel is driven by the roller elements.

7. The system of claim 1, wherein the walls of the first fluid channel are formed during molding of the pump body and are configured to receive the one or more roller components.

8. The system of claim 1, wherein the rotatable portion further comprises:

a drive motor configured to cause the rotatable portion to rotate.

9. The system of claim 6, further comprising:

a controller configured to drive the motor to dispense a specified amount of fluid.

10. The system of claim 1, wherein the respective first and second rigid walls of first fluid channel and the second fluid channel form concentric arcs in the pump body coupled together by a connector channel.

11. The system of claim 1, wherein the semi-rigid membrane is bonded to the pump body such that it overlaps the portions of both the first fluid channel and the second fluid channel defined by the first and second rigid walls of the pump body.

12. The system of claim 1, wherein the second fluid channel is defined in part by second rigid walls of the pump body and in part by the semi-rigid membrane, and wherein the first rigid walls of the pump body and the second rigid walls of the pump body form circular segments and wherein the semi-rigid membrane seals a portion of each circular segment to form arc shaped fluid channels.

13. The system of claim 1, wherein the output port is positioned at a location in the pump body a specified non-zero distance from an end of the second fluid channel.

14. A fluid pump, comprising:

a pump head including one or more recesses configured to receive one or more corresponding roller elements; and a pump body including an input port, and output port, a first fluid channel, and a second fluid channel, wherein the first fluid channel is defined in part by first rigid walls of the pump body and the second fluid channel is defined in part by second rigid walls of the pump body, wherein the first and second fluid channels form concentric arcs such that the first fluid channel substantially encircles the second fluid channel, and wherein the respective rigid walls of the first and second fluid channels being substantially in the same plane of the pump body; and a semi-rigid membrane positioned on at least a portion of the pump body to enclose the first rigid walls to form the first fluid channel and to enclose the second rigid walls to form the second fluid channel, and wherein the input port is formed by an aperture in the pump body perpendicular to a path of the first fluid channel and the output port is formed by an aperture in the pump body perpendicular to a path of the second fluid channel;

wherein the pump head is rotatably coupled to the pump body such that the one or more roller elements interface with the semi-rigid membrane such that during rotation the roller elements compress the semi-rigid membrane to push fluid trapped within the first fluid channel, the fluid bounded within a region formed by the first rigid walls of the pump body and the semi-rigid membrane, in the direction of rotation and wherein fluid pushed through the first fluid channel passes to the second fluid channel, and wherein fluid in the second fluid channel passes to the output port.

15. The fluid pump of claim 14, wherein the pump body further comprises a connector that couples the first fluid channel and the second fluid channel, and wherein fluid pushed through the first fluid channel passes through the connector to the second fluid channel.

16. The fluid pump of claim 14, wherein the input port is coupled to the first fluid channel.

17. The fluid pump of claim 14, wherein the output port is coupled to the second fluid channel.

18. The fluid pump of claim 14, wherein the semi-rigid membrane is bonded to the pump body by a bonding material injected into a sealing channel formed in the pump body and thereby enclosing the fluid channel.

19. The fluid pump of claim 14, wherein only the first fluid channel is driven by the roller elements.

20. The fluid pump of claim 14, wherein the walls of the first fluid channel are formed during molding of the pump body and are configured to receive the one or more roller components.

* * * * *